US007779611B2

(12) United States Patent
Hashiba et al.

(10) Patent No.: US 7,779,611 B2
(45) Date of Patent: Aug. 24, 2010

(54) APPARATUS AND METHOD FOR PACKAGING GRANULAR OBJECT HAVING ADSORPTION ABILITY, AND METHOD FOR PRODUCING PACKAGE THEREOF

(75) Inventors: Yoshitugi Hashiba, Fukushima (JP); Hitoshi Takahashi, Fukushima (JP); Eisaku Takahashi, Fukushima (JP)

(73) Assignee: Kureha Corporation, Tokyo (JP)

( * ) Notice: Subject to any disclaimer, the term of this patent is extended or adjusted under 35 U.S.C. 154(b) by 502 days.

(21) Appl. No.: 10/567,032

(22) PCT Filed: Aug. 5, 2004

(86) PCT No.: PCT/JP2004/011270

§ 371 (c)(1), (2), (4) Date: May 31, 2007

(87) PCT Pub. No.: WO2005/012095

PCT Pub. Date: Feb. 10, 2005

(65) Prior Publication Data

US 2007/0289257 A1 Dec. 20, 2007

(30) Foreign Application Priority Data

Aug. 5, 2003 (JP) ..... 2003-205996

(51) Int. Cl.
*B65B 63/08* (2006.01)

(52) U.S. Cl. ..... 53/440; 53/127

(58) Field of Classification Search ..... 53/440, 53/451, 477, 469, 127, 111, 574
See application file for complete search history.

(56) References Cited

U.S. PATENT DOCUMENTS 3,269,079 A * 8/1966 Schmied ..... 53/426

(Continued)

FOREIGN PATENT DOCUMENTS

CH 288910 6/1953

(Continued)

OTHER PUBLICATIONS

International Search Report.

*Primary Examiner*—Paul R Durand
(74) *Attorney, Agent, or Firm*—Reed Smith LLP

(57) ABSTRACT

An object of the present invention is to provide a packaging apparatus for packaging a granular object having adsorption ability, which does not spill out of the package when the package is opened.

An apparatus for packaging a granular object having adsorption ability comprises a heating device 12 for heating a granular object having adsorption ability, a charging device 30 for charging the granular object into a storage bag 90 having an open end, a sealing device 40 for sealing the open end of the storage bag 90 into which the granular object has been charged, and a cooling device 70 for cooling a storage bag 91 with the granular object kept to be gathered at the bottom of the storage bag 91, wherein the heating device 12 is located upstream of the sealing device 40 along the flowing direction of the granular object.

12 Claims, 1 Drawing Sheet

U.S. PATENT DOCUMENTS

| | | | | | |
|---|---|---|---|---|---|
| 3,469,363 | A | * | 9/1969 | Berckmoes | 53/440 |
| 3,542,570 | A | | 11/1970 | Bush, et al. | |
| 3,987,602 | A | * | 10/1976 | Stahl | 53/440 |
| 4,563,862 | A | * | 1/1986 | McElvy | 53/552 |
| 5,251,424 | A | * | 10/1993 | Zenger et al. | 53/431 |
| 5,546,733 | A | * | 8/1996 | Paltrinieri | 53/503 |
| 5,682,758 | A | * | 11/1997 | Jones | 62/374 |
| 5,701,724 | A | | 12/1997 | Meli et al. | |
| 6,058,680 | A | * | 5/2000 | Meli et al. | 53/451 |
| 6,131,368 | A | * | 10/2000 | Tramposch et al. | 53/400 |
| 6,138,441 | A | * | 10/2000 | Kik et al. | 53/440 |
| 6,155,029 | A | * | 12/2000 | Jain | 53/440 |
| 6,364,090 | B1 | * | 4/2002 | Wild et al. | 198/408 |

FOREIGN PATENT DOCUMENTS

| | | |
|---|---|---|
| FR | 2753714 | 3/1998 |
| GB | 1366798 | 9/1974 |
| JP | 63-191724 | 8/1988 |
| JP | 06-190021 | 7/1994 |
| WO | WO97/00813 | 1/1997 |

* cited by examiner

APPARATUS AND METHOD FOR PACKAGING GRANULAR OBJECT HAVING ADSORPTION ABILITY, AND METHOD FOR PRODUCING PACKAGE THEREOF

TECHNICAL FIELD

The present invention relates to an apparatus and a method for packaging a granular object having adsorption ability and a method for producing a package of the granular object having adsorption ability, more particularly to a packaging apparatus, a packaging method, and a method for producing a package out of which the packaged granular object does not spill when the package is opened.

BACKGROUND ART

A granular object having high adsorption ability such as spherical adsorptive carbon can adsorb a large amount of air, and the amount of air varies tremendously depending on temperature. Therefore, when the temperature is increased after packaging, air is emitted from the granular object and the package is expanded in volume and largely deformed. Such deformation causes many problems during encasement, storage, transportation and so on. Therefore, various measures have been taken, including a measure to charge spherical adsorptive carbon into packages at a high temperature or to seal the packages under a pressure lower than atmospheric pressure (see Patent Document 1).

Patent Document 1: Japanese Patent Registration No. JP2607422B (pp. 3-4)

DISCLOSURE OF THE INVENTION

Problem to be Solved by the Invention

However, it has been found that there are many cases where a granular object having adsorption ability and charged at a high temperature spills out of the package when it is opened. The inventors have found that if the package is encased or laid flat immediately after the granular object was charged at a high temperature, the granular object moves in the package before the package is cooled and the volume of air in the package decreases to make the granular object settle at the bottoms of the package, which may cause the granular object to spill out of the package when it is opened. The present invention has been made based on the findings and it is, therefore, an object of the present invention to provide a packaging apparatus, a packaging method, and a package production method for producing a package out of which the packaged granular object does not spill when the package is opened.

Means for Solving the Problem

In order to accomplish the above object, an apparatus for packaging a granular object having adsorption ability according to the present invention, comprises as shown in FIG. 1 for example: a heating device 12 for heating a granular object having adsorption ability; a charging device 30 for charging the granular object into a storage bag 90 having an open end; a sealing device 40 for sealing the open end of the storage bag 90 into which the granular object has been charged; and a cooling device 70 for cooling a storage bag 91 with the granular object kept to be gathered at the bottom of the storage bag 91, wherein the heating device 12 is located upstream of the sealing device 40 along the flowing direction of the granular object.

In this configuration, since the storage bag containing heated granular object having adsorption ability is sealed and then cooled with the granular object gathered at the bottom of the storage bag, the granular object is stably settled at the bottom of the package. Therefore, the granular object does not spill out of the package when the package is opened. To have "adsorption ability" means an ability, for example of spherical adsorptive carbon and activated carbon, to retain gas such as air.

An apparatus for packaging a granular object having adsorption ability according to the present invention may be, as shown in FIG. 1 for example, the apparatus for packaging a granular object having adsorption ability as described above, wherein the cooling device 70 quickly cools the storage bag 91 so that the inner surfaces of the part of the storage bag 91 where the granular object, which is gathered at the bottom of the storage bag 91, is not contained, come into close contact with each other.

In this configuration, since the inner surfaces of the part where the granular object is not contained come into close contact with each other, the granular object gathered at the bottom of the package is prevented from moving about within the package.

An apparatus for packaging a granular object having adsorption ability according to the present invention may be, as shown in FIG. 1 for example, the apparatus for packaging a granular object having adsorption ability as described above, wherein the heating device 12 heats the granular object to a temperature not lower than 55° C. and not higher than 80° C.

In this configuration, since the storage bag containing the granular object is sealed while the granular object is heated to a temperature higher than the highest temperature to which the granular object may be exposed in ordinary circumstances, air is not emitted from the granular object when the temperature elevates after sealing. Therefore, the package is not expanded and the granular object stays at the bottom of the package. Also, since the heating temperature of the granular object is not very high, the charging performance is not adversely affected.

An apparatus for packaging a granular object having adsorption ability according to the present invention may be, as shown in FIG. 1 for example, the packaging apparatus for a granular object having adsorption ability According to any one of the above apparatuses, wherein the cooling device 70 may hold the storage bag 91 in a position along the direction of gravity or inclined to the direction of gravity during cooling the storage bag 91.

In this configuration, the storage bag is held in a position along the direction of gravity or inclined to the direction of gravity when cooled, the granular object is kept stable at the bottom of the package when cooled.

In order to accomplish the above object, a method for packaging a granular object having adsorption ability according to the present invention, comprises, as shown in FIG. 1 for example, the steps of: heating granular object having an adsorption ability; charging the granular object into a storage bag 90 having an open end; sealing the open end of the storage bag 90 into which the granular object has been charged; and cooling a storage bag 91 with the granular object kept to be gathered at the bottom of the storage bag 91, wherein the heating is conducted prior to the sealing.

In this configuration, since the storage bag containing heated granular object having adsorption ability is sealed and then cooled with the granular object gathered at the bottom of the storage bag, the granular object is stably settled at the bottom of the package. Therefore, the granular object does not spill out of the package when the package is opened.

Furthermore, a method for producing a package according the present invention, comprises, as shown in FIG. 1 for example, the steps of: supplying a granular object having adsorption ability to any one of above apparatuses for packaging the granular object having adsorption ability; heating the granular object with the heating device 12; charging the granular object into a storage bag 90 with the charging device 30; sealing the storage bag 90 into which the granular object has been charged with the sealing device 40; cooling a sealed storage bag 91 with the cooling device 70; and taking the cooled storage bag 91 out of the packaging apparatus as a package.

In this configuration, there is provided a method for producing a package in which the granular object having adsorption ability is settled at the bottom and out of which the granular object does not spill when the package is opened.

The basic Japanese Patent Application No. 2003-205996 filed on Aug. 5, 2003 is hereby incorporated in its entirety by reference into the present application.

The present invention will become more fully understood from the detailed description given hereinbelow. However, the detailed description and the specific embodiment are illustrated of desired embodiments of the present invention and are described only for the purpose of explanation. Various changes and modifications will be apparent to those ordinary skilled in the art within the spirit and scope of the present invention on the basis of the detailed description.

The applicant has no intention to give to public any disclosed embodiments. Among the disclosed changes and modifications, those which may not literally fall within the scope of the present claims constitute, therefore, a part of the present invention in the sense of doctrine of equivalents.

The use of the terms "a" and "an" and "the" and similar referents in the specification and claims are to be construed to cover both the singular and the plural, unless otherwise indicated herein or clearly contradicted by context. The use of any and all examples, or exemplary language (e.g., "such as") provided herein, is intended merely to better illuminate the invention and does not pose a limitation on the scope of the invention unless otherwise claimed.

Effects of the Invention

As described previously, according to the present invention, since the granular object is charged after being heated and the package is cooled with the granular object kept at the bottom of the package after sealing, the granular object is stably settled at the bottom of the package. Therefore, there can be provide a packaging apparatus, a packaging method and a package production method for producing a package out of which the granular object does not spill when the package in opened at ambient temperature.

Best Mode for Carrying Out the Invention

The embodiments of the present invention are hereinafter described with reference to the drawings.

A packaging apparatus according to an embodiment of the present invention is described with reference to the schematic view of FIG. 1. FIG. 1 shows an apparatus for packaging spherical adsorptive carbon having, top to bottom, a hopper 10 and a heating device 12, a measuring device 20, a charging device 30, a sealing device 40, a pinching device 50, a cutting device 60, and a cooling device 70.

The hopper 10 is a container having a wide upper opening and narrowing gradually toward the lower end. The lower end of the hopper 10 is opened and communicated with a filling nozzle 16. The hopper has a heater 12 as a heating device, and the spherical adsorptive carbon in the hopper is heated at 60 to 80° C. The heating device, which may be provided separately from the hopper 10, is disposed upstream of the sealing device 40 along the flowing direction of the spherical adsorptive carbon. Since the spherical adsorptive carbon flows from top to bottom in FIG. 1, the heating device is located in an upper part in FIG. 1. In this case, the heating device is preferably located upstream of the hopper 10 or between the hopper 10 and the measuring device 20. This is because when the heating device is located downstream of the measuring device 20, the spherical adsorptive carbon must be heated every measured unit, that is, a small amount of spherical adsorptive carbon must be heated within a short period of time. Alternatively, hot air from a heating device may be passed through the hopper 10 to heat the spherical adsorptive carbon therein.

The filling nozzle 16 under the hopper 10 is a thin pipe so that the spherical adsorptive carbon in the hopper can be discharged little by little. The lower end of the filling nozzle 16 is located and opens in the through hole 22*a* of the holder 22.

The holder 22 is combined with a measuring vessel 21 reciprocating horizontally under the holder 22, a shutter 24 placed under the measuring vessel 21, and springs 23 for pressing the holder 22 against the measuring vessel 21 under the holder 22 to constitute the measuring device 20. The springs 23 are provided to keep the holder 22 in close contact with the measuring vessel 21 so that the spherical adsorptive carbon granules cannot be caught between them and cannot scratch the surfaces thereof. The springs 23 may not be provided.

The measuring vessel 21 has a space 21*a* with a capacity equal to the volume of spherical adsorptive carbon to be measured. The space 21*a* is communicable with the through hole 22*a* of the holder 22. When the measuring vessel 21 moves horizontally, the space 21*a* is communicated with a through hole 24*a* of a shutter 24.

The shutter 24 of the measuring device 20 has a through hole 24*a* with a lower opening communicated with a chute pipe 31. The chute pipe 31 has a funnel-like upper portion with a wide opening for receiving the spherical adsorptive carbon falling through the through hole 24*a* of the shutter 24 and a narrow pipe-like lower portion. The chute pipe 31 has the opened lower end.

A tubular tube 90 for packaging the spherical adsorptive carbon is placed below the chute pipe 31 with its opening facing upward. The tube 90 is produced by forming a flat tape-like sheet into a tubular shape below the chute pipe 31. The tube 90 is transversely sealed as described later to form a bag sealed at the bottom.

A sealing device 40 is disposed below the opening of the chute pipe 31 for sealing the tube 90 transversely. The sealing device 40 heat-seals the tube 90 containing spherical adsorptive carbon transversely at a prescribed length by pinching the tube 90 with top seal bars 41. The top seal bars 41, which are two metal blocks with flat ends, are heated by a heater and pinch the tube 90 from both sides to heat-seal the tube 90. While pinching the tube 90 the top seal bars 41 pull down the tube 90 to place the sealed part at the position of the bottom of the next bag for receiving spherical adsorptive carbon.

In synchronization with the motion of the top seal bars 41 of the sealing device 40, a pinching device 50 located right below the sealing device operates. The pinching device 50 pinches the part of the tube 90 to be sealed by the sealing device 40 with air expel guides 51 to expel the air in the tube 90 in order to prevent the produced package from expanding with an increase in temperature. Each of the air expel guides 51 has a bulged upper portion and a recessed lower portion. Therefore, the spherical adsorptive carbon is placed at the bottom of the bag formed from the tube 90, and an upper part of the tube 90 is pressed flat so that nothing can be contained in the upper part of the bag. The top seal bars 41 and the air expel guides 51 are arranged so as to pinch the tube 90 in the same direction.

A cutting device 60 is disposed below the pinching device 50 for cutting the tube 90 containing spherical adsorptive carbon at the sealed parts into packet 91 or package 92 consisting of a plurality of packets 91. Here, the term "packet" means each of the sealed bags containing a granular object measured by the measuring device, and the term "package" means each bag or set of bags cut at the sealed parts and discharged from the packaging apparatus. The cutting device 60 has two blades which pinch and cut the tube 90. The package 92 of a plurality of packets 91 containing spherical adsorptive carbon and joined end to end may be perforated at the sealed parts left uncut so that packets 91 can be easily separated by hand. Therefore, the cutting device 60 may also have blades each of which has an edge with notches at equal intervals and which are operated at different timing from the cutting blades.

A receiving table 61 is located below the cutting device 60. The receiving table 61 is a tilted plate that allows the cut package 92 to fall obliquely to reduce the impact of the fall. The receiving table 61 has a shock absorbing roller 62 for further reducing the falling speed of the packages 92. The shock absorbing roller 62 is located in such a position that the package 92 passes between two cylindrical rollers of the shock absorbing roller 62 while sliding down on the receiving table 61. Since the package 92 rotate the rollers when passing therebetween, the falling speed of the package 92 is reduced. The shock absorbing roller 62 may have only one roller. Another means for reducing the falling speed of the package 92 may be provided instead of the shock absorbing roller 62. For example, some means for increasing friction may be provided on the receiving table 61.

A cooling device 70 is disposed downstream of the receiving table 61. The cooling device 70 has a conveyor 71 and supports 72 for supporting the package 92 in an obliquely upstanding position arranged on the conveyor 71 and moving together with the conveyor 71. Although the conveyor 71 is linear in FIG. 1, it maybe of another shape such as oval, circular or elliptical. The supports 72 are plates or rods obliquely extending from the conveyor 71. The supports 72 support the package 92 such that the short sides of the package 92 are perpendicular to the transporting direction. Then, a larger number of packages 92 can be supported on the conveyor 71 with the same length. At the end opposite the receiving table 61 where the conveyer 71 turns around, the package 92 falls by gravity. The package 92 falls into a container for packing the package 92, and the package 92 is packed and shipped.

Cooling air is blown onto the cooling device 70 by a blower (not shown). Here, the term "cooling air" means air with ambient temperature or a temperature lower than ambient temperature, and the term "ambient temperature" is the temperature at which the packages are usually used. In many cases, the ambient temperature is the room temperature in houses or offices where the packages are opened.

The method of producing the package 92 of spherical adsorptive carbon is next described with reference to FIG. 1. Spherical adsorptive carbon is supplied into the hopper 10 through the upper opening thereof and temporally stored in the hopper 10. The spherical adsorptive carbon is heated at 55 to 80° C. by the heater 12 while being stored in the hopper 10. When the temperature of heating the granular object in packets is within 55 to 80° C., air is not emitted from the granular object during or after packaging even if the temperature is increased after sealing. The packets 91 are therefore not expanded and the spherical adsorptive carbon stays at the bottom of each packet 91. Additionally, the heating temperature of the spherical adsorptive carbon is not very high, the charging performance is not adversely affected. Preferably, the spherical adsorptive carbon is heated at a temperature of 65 to 75° C., and charged into the tube 90 at approximately 60° C. The packets 91 are rarely exposed to a temperature of 60° C. during their ordinary distribution process. Therefore, when the spherical adsorptive carbon has been heated to approximately 60° C., the packets 91 do not cause any problem, such as that the packets 91 encased in a box expand to break the box. Also, the heating temperature is not so high to adversely affect the charging performance during charging to prevent proper charging.

The spherical adsorptive carbon gradually descends in the hopper 10 and flows into the filling nozzle 16 from the lower end of the hopper 10. The inside diameter of the filling nozzle 16 is so selected that an appropriate amount of spherical adsorptive carbon can be passed through the filling nozzle 16 and discharged from the hopper 10. A valve may be provided in the filling nozzle 16 for controlling the amount of spherical adsorptive carbon to be discharged.

The spherical adsorptive carbon is supplied from the filling nozzle 16 into the space 21*a* of the measuring vessel 21 through the holder 22. When the space 21*a* is filled with spherical adsorptive carbon, the measuring vessel 21 moves horizontally. Then, the spherical adsorptive carbon in the space 21*a* is fed into the chute pipe 31 through the through hole 24*a* of the shutter 24. Spherical adsorptive carbon in an amount equal to the capacity of the space 21*a* is measured by a measuring device 20.

At the same time when the spherical adsorptive carbon is supplied to the hopper 10, a sheet wound in a roll is pulled out at a prescribed speed and formed into a tubular shape in the vicinity of the lower end of the chute pipe 31. The overlapped portions of the sheet are heat-sealed to form the tube 90. The tube 90 is sealed transversely at a prescribed position by the sealing device 40 as described later. The tube 90 is formed into a bag sealed at the bottom having an open end, and placed with its opening facing the lower opening of the chute pipe 31. The storage bags for spherical adsorptive carbon are preferably produced from the tube 90 since the storage bags can be supplied continuously. The storage bags may not be joined as a tube but may be bags with an open end separated individually, through. It is preferable to use a storage bag having inner surfaces facing each other, along its wide sides, where the surfaces can be brought into close contact with each other at least at their upper portions when cooled after a granular object to be packaged has been gathered at the bottoms of the storage bag by gravity. One example is three-side sealed bags.

The spherical adsorptive carbon measured by the measuring device 20 is poured into the bag-shaped part of the tube 90 through the chute pipe 31 and is heaped up in the lower part of the bag-shaped part. Then, the air expel guides 51 of the pinching device 50 pinch the bag-shaped part from both sides to expel the air therein. Almost as soon as the pinching device 50 expels the air, the tube 90 is sealed transversely by the sealing device 40 at a position immediately above the part from which air has been expelled by the pinching device 50. The tube 90 is made of a multi-layer film having an inner layer of a heat-sealable plastic film and can be sealed when pinched by heated top seal bars 41. The top seal bars 41 may seal the tube 90 by means other than heat sealing, such as ultrasonic sealing.

The top seal bars 41 move down a distance equal to the length of the bag for the spherical adsorptive carbon while pinching the tube 90. By this movement, the sealed part made to close the bag containing spherical adsorptive carbon becomes the bottom of the next bag-shaped part of the tube 90.

The packets 91 containing spherical adsorptive carbon and sealed transversely are cut at the sealed parts into for example each packet or a package of three packets by the cutting device 60. When a package of a plurality of packets is cut off, the package may be perforated at the sealed parts between the packets by being pinched between blades each having an edge with notches at equal intervals so that the packets can be easily separated by hand.

The package 92 cut by the cutting device 60 slides down on the receiving table 61, is reduced in falling speed by the shock absorbing roller 62 and falls down onto the cooling device 70. Here, the spherical adsorptive carbon still keeps a higher temperature since the spherical adsorptive carbon as a solid matter having high heat capacity is cooled slowly through heat exchange with the outside environment. On the other hand, since the air in the packets 91 has low heat capacity, it is cooled correspondingly. Therefore, the packets 91 are shrunk when the air therein is cooled. Before each packet 91 falls down and experiences a shock, the spherical adsorptive carbon with a large weight dynamically gathers at the bottom of each packet 91, and with its counteraction, the gap between the inner surfaces of the upper portion of each packet 91 is narrowed until both inner surfaces come into contact with each other. That is, the inner surfaces are brought into close contact with each other by the gathering of the spherical adsorptive carbon at the bottom of each packet 91 caused by gravity and the shrinkage of air in each packet 91. As a result, even when the shock of the fall is applied, the spherical adsorptive carbon is cooled without being moved to the upper portion of each packet 91 by the shock of the fall since the inner surfaces of the film is in close contact with each other.

After cutting, the package 92 may be slid on a slope other than dropped. The tilt angle of the slope gradually decreases so that it can takes a long time for the package 92 to be stopped by the friction between it and the slope surface. The packages 92 can be therefore cooled without applying shocks thereto. When the cut or separated packet 91 is floated in a liquid coolant such as water by the buoyant of the liquid, the packet 91 can be cooled without applying shocks thereto and kept in an upright posture in the liquid. In this case, there is no need to bring the inner surfaces into close contact with each other before the spherical adsorptive carbon leaps since no shock is applied to the packet 91.

Since the package 92 falls onto the cooling device 70 at a low speed, the seals at the bottoms of the package 92 is not damaged by the impact of the fall. The package 92 fed onto the cooling device 70 are held in an obliquely upstanding position by the supports 72 and transported on the conveyor 71 of the cooling device. In the meantime, cooling air is blown onto the packages 92 by a blower. Each package 92 is held in a position along the direction of gravity or inclined to the direction of gravity and maintained at such an angle that the spherical adsorptive carbon is kept settled at the bottom of each packet 91 on the cooling device 70. For example, the angle is 0 to 70°, preferably 0 to 50°, more preferably 0 to 40° with respect to the direction of gravity. The cooling air is the air cooled to a temperature lower than room temperature by a chiller. Thus, the cooling rate can be enhanced and the productivity can be improved. As a result, the spherical adsorptive carbon heated at a temperature of 55 to 80° C. in the hopper 10 and still keeping the temperature is then cooled to almost room temperature. When cooled, each packet 91 is shrunk and the spherical adsorptive carbon is settled at the bottom of each packet 91 and cannot move any more. The cooling air is not necessarily kept blown onto each package 92 while the package 92 is on the cooling device 70. The packages 92 may be exposed to room temperature after being exposed to cooling air. For example, in the apparatus for packaging 2 g of spherical adsorptive carbon heated to 60° C., the packets 91 can be sufficiently cooled when transported in cooling air with a temperature of 25° C. or lower, preferably 15° C. or lower, for approximately 5 seconds or longer.

When the package 92 is transported to an end of the conveyer 71, the conveyor 71 turns downward and the package 92 falls by gravity. A packing box is placed at the position where the package 92 falls. When a predetermined number of packages 92 are put in the box, the box is carried away.

As described previously, since spherical adsorptive carbon is charged at a temperature of 55 to 80° C., which is higher than the highest temperature to which the spherical adsorptive carbon may be exposed during ordinary storage, in the packaging apparatus according to an embodiment of the present invention, the air contained in the spherical adsorptive carbon is not emitted even if the temperature is increased after packaging. Therefore, the packets 91 are not filled with air and the spherical adsorptive carbon is kept settled at the bottom of each packet 91 and cannot move. Therefore, the spherical adsorptive carbon does not spill out of the packets 91 when the packets 91 are opened.

In addition, since the spherical adsorptive carbon is heated to a temperature of 55 to 80° C., which is only several dozens degrees higher than room temperature, the spherical adsorptive carbon can be quickly cooled to a temperature close to room temperature by cooling air. Therefore, the packages can be encased after a short period of time after packaging.

Moreover, the packets 91 are cooled quickly since they are cooled by blowing air with a temperature lower than room temperature onto them on the cooling device 70. As the temperature of heated spherical adsorptive carbon is decreased, the spherical adsorptive carbon contains a larger amount of air and a vacuum is established in the packets 91. Then, each packet 91 is shrunk and the spherical adsorptive carbon is settled at the bottom of each packet 91 and cannot move anymore. Therefore, the spherical adsorptive carbon does not spill out of the packets 91 when the packets 91 are opened. Especially, since the spherical adsorptive carbon is cooled quickly, the spherical adsorptive carbon is prevented from moving in the packets 91 before being cooled.

Here, spherical adsorptive carbon to be packaged by the packaging apparatus or the packaging method according to the embodiment of the present invention is described. The spherical adsorptive carbon granule is of porous spherical carbon object with granule size between 0.05 and 1 mm in diameter and a bulk density of 0.51±0.04 g/ml. Since the spherical adsorptive carbon granule is of a perfect spherical shape and has high fluidity, it is likely to be scattered in opening a packet. Also, spherical adsorptive carbon contains a large amount of air, and the amount of air tremendously varies depending on temperature. For example, when spherical adsorptive carbon is heated from zero to 30° C., it emits 1.46 ml of air per gram. Since spherical adsorptive carbon is heated at 60 to 80° to fully expel air therefrom and cooled after being sealed in the packets, a vacuum is established in the packets and the spherical adsorptive carbon do not move about in the packets.

Although spherical adsorptive carbon is taken as an example of the granular object to be measured and packaged, the present invention is suitably applicable to any granular objects having adsorption ability and a perfect spherical shape. The packaging apparatus, the packaging method and the method for producing a package according to the present invention are applicable to other granular objects having adsorption ability. In the above embodiment, it is assumed that when the package is heated after the granular object has been cooled and the pressure in the package has been reduced, the spherical adsorptive carbon moves to the upper portion of the package and spills out of the package when the package is opened as in the case with a conventional package. However, when spherical adsorptive carbon is packaged as described above, the spherical adsorptive carbon does not become movable unless the package is heated up to approximately 70° C. Any device for expelling the air in the storage bags can be used instead of the pinching device. For example, a decompressor may be used. When the pressure is reduced, the open end of the storage bag is preferably surrounded by a screen so that the granular object cannot be scattered when the pressure is reduced. In this case, the mesh of the screen must be smaller than the size of the granular object so that the granular object cannot pass through the screen even if the screen is deformed. Although the present invention is described as a packet for containing a granular object measured by a measuring device, the present invention is applicable to ordinary packages.

DESCRIPTION OF REFERENCE NUMERALS

Figure 1:
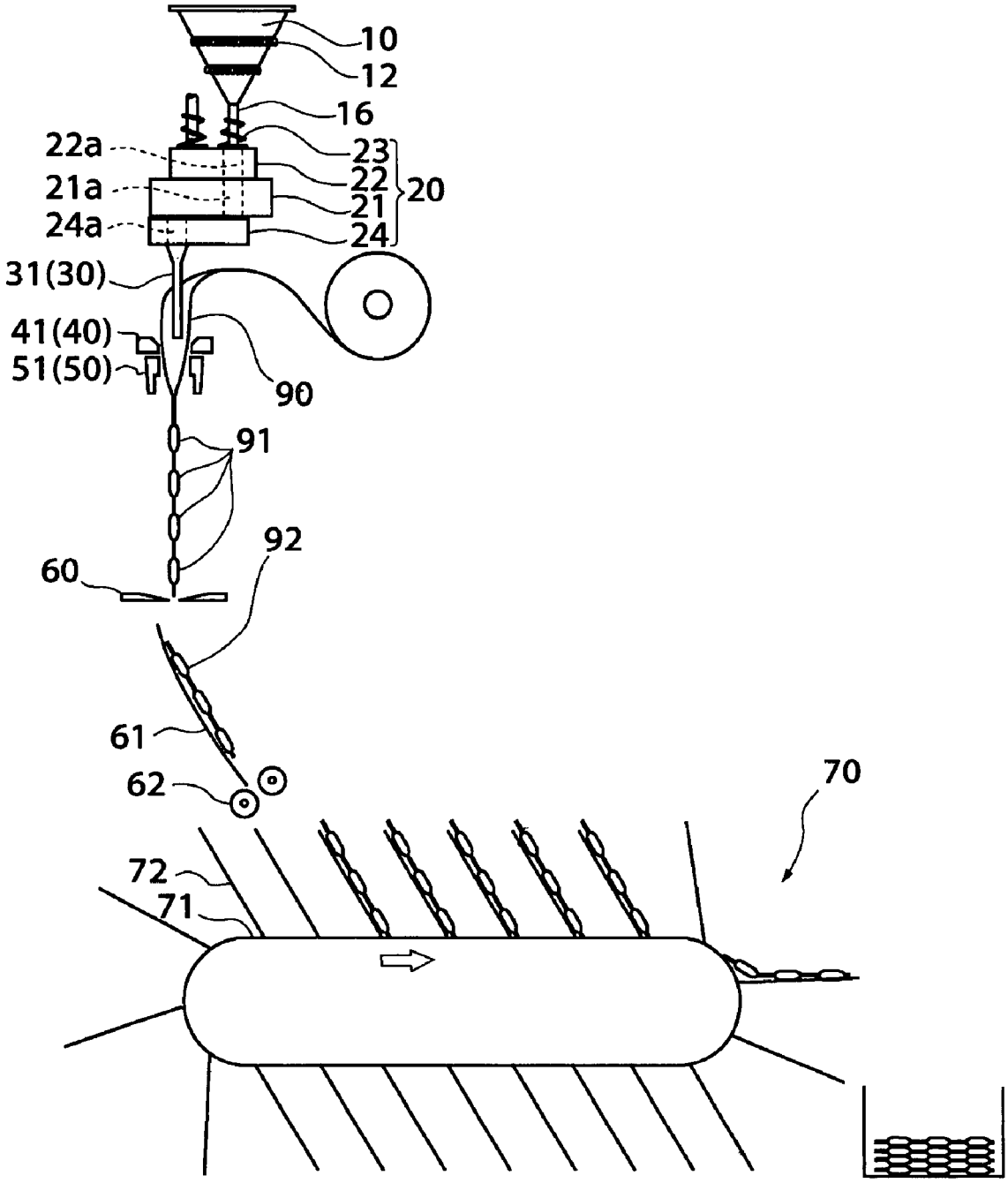
FIG. 1 is a schematic view, illustrating a packaging apparatus according to an embodiment of the present invention.

12: heating device
20: measuring device
30: charging device
40: sealing device
50: pinching device
60: cutting device
61: receiving table
62: shock absorbing roller
70: cooling device
92: package

The invention claimed is:

1. A method for producing a package packaging a granular object having an adsorption ability, comprising the steps of:

heating a granular object having an adsorption ability;

charging the granular object into a storage bag having an end opening facing upward and an opposite closed end pressed flat;

pressing flat to seal the end opening facing upward of the storage bag into which the granular object has been charged;

cooling the storage bag with the granular object kept to be settled at a bottom pressed flat of the storage bag, and pressing an upper part of the storage bag where the granular object is not contained and a lower part of the storage bag where the granular object is settled, before the storage bag is sealed, so as to keep inner surfaces of the upper part without the granular object settled at the bottom of the storage bag into close contact with each other and to keep the granular object from moving when the sealed storage bag is cooled, wherein the step of heating is conducted prior to the step of sealing.

2. The method for producing a package packaging a granular object having adsorption ability of claim 1, further comprising the steps of:

cutting the sealed storage bag to make a package, the package comprising one or more packets, each packet being an independent sealed bag containing the granular object; and reducing falling speed of the package before the cooling step.

3. A packaging apparatus for a granular object having adsorption ability, comprising:

a heating device for heating a granular object having adsorption ability;

a charging device for charging the granular object into a storage bag having an end opening facing upward and an opposite closed end pressed flat;

a sealing device for pressing flat to seal the end opening facing upward of the storage bag into which the granular object has been charged;

a cooling device for cooling the storage bag with the granular object, having a support for supporting the storage bag with the granular object keeping the end sealed by the sealing device higher than the opposite closed end, the granular object being kept settled at a bottom pressed flat of the storage bag by the support; and a pinching device having a bulged upper portion and a recessed lower portion for pressing an upper part of the storage bag where the granular object is not contained and a lower part of the storage bag where the granular object is settled, before the storage bag is sealed, so as to keep inner surfaces of the upper part without the granular object settled at the bottom of the storage bag into close contact with each other and to keep the granular object from moving when the storage bag sealed by the sealing device is cooled by the cooling device, wherein the heating device is located upstream of the sealing device along the flowing direction of the granular object.

4. The apparatus for packaging a granular object having adsorption ability of claim 3, wherein the heating device heats the granular object to a temperature not lower than 55° C. and not higher than 80° C.

5. The apparatus for packaging a granular object having adsorption ability of claim 4, wherein the support is of plate or rod being extended so as to hold the direction of connecting the part of the storage bag in which the granular object settled and the part of the storage bag sealed in a position along the direction of gravity or inclined to the direction of gravity.

6. The apparatus for packaging a granular object having adsorption ability of claim 3, wherein the support is of plate or rod being extended so as to hold the direction of connecting the part of the storage bag in which the granular object settled and the part of the storage bag sealed in a position along the direction of gravity or inclined to the direction of gravity.

7. The apparatus for packaging a granular object having adsorption ability of claim 3, further comprising:

a cutting device for cutting the storage bag sealed with the sealing device to make a package, the package comprising one or more packets, each packet being an independent sealed bag containing the granular object; and a receiving table located below the cutting device for reducing falling speed of the package while the package is falling toward the cooling device.

8. The apparatus for packaging a granular object having adsorption ability of claim 7, wherein the receiving table comprises a shock absorbing roller for further reducing falling speed of the package.

9. A method for producing a package, comprising the steps of:

supplying a granular object having adsorption ability to a packaging apparatus for a granular object having adsorption ability according to claim 3;

heating the granular object with the heating device;

charging the granular object into a storage bag with the charging device;

sealing the storage bag into which the granular object has been charged with the sealing device;

cooling the sealed storage bag with the cooling device; and taking the cooled storage bag out of the packaging apparatus as a package.

10. A method for producing a package, comprising the steps of:

supplying a granular object having adsorption ability to a packaging apparatus for a granular object having adsorption ability according to claim 4;

heating the granular object with the heating device;

charging the granular object into a storage bag with the charging device;

sealing the storage bag into which the granular object has been charged with the sealing device;

cooling the sealed storage bag with the cooling device; and taking the cooled storage bag out of the packaging apparatus as a package.

11. A method for producing a package, comprising the steps of:

supplying a granular object having adsorption ability to a packaging apparatus for a granular object having adsorption ability according to claim 6;

heating the granular object with the heating device;

charging the granular object into a storage bag with the charging device;

sealing the storage bag into which the granular object has been charged with the sealing device;

cooling the sealed storage bag with the cooling device; and taking the cooled storage bag out of the packaging apparatus as a package.

12. A method for producing a package, comprising the steps of:

supplying a granular object having adsorption ability to a packaging apparatus for a granular object having adsorption ability according to claim 5;

heating the granular object with the heating device;

charging the granular object into a storage bag with the charging device;

sealing the storage bag into which the granular object has been charged with the sealing device;

cooling the sealed storage bag with the cooling device; and taking the cooled storage bag out of the packaging apparatus as a package.

* * * * *